US007578711B2

(12) United States Patent
Robinson

(10) Patent No.: US 7,578,711 B2
(45) Date of Patent: Aug. 25, 2009

(54) DEVICES, SYSTEMS, AND METHOD FOR COUPLING ELECTRICAL CONDUCTORS

(75) Inventor: Kristopher Scott Robinson, Atlanta, GA (US)

(73) Assignee: Siemens Energy & Automation, Inc., Norcross, GA (US)

( * ) Notice: Subject to any disclaimer, the term of this patent is extended or adjusted under 35 U.S.C. 154(b) by 0 days.

(21) Appl. No.: 12/059,268

(22) Filed: Mar. 31, 2008

(65) Prior Publication Data

US 2009/0088029 A1 Apr. 2, 2009

Related U.S. Application Data

(60) Provisional application No. 60/911,600, filed on Apr. 13, 2007.

(51) Int. Cl.
*H01R 4/30* (2006.01)

(52) U.S. Cl. ..... 439/801; 361/634; 335/202; 439/883

(58) Field of Classification Search ..... 439/801, 439/883, 811; 361/634, 636, 640, 655; 335/202; 174/72 B See application file for complete search history.

(56) References Cited

U.S. PATENT DOCUMENTS

| | | | | |
|---|---|---|---|---|
| 3,375,411 | A * | 3/1968 | Mrowka | 361/637 |
| 4,210,379 | A | 7/1980 | Vachhani | |
| 5,744,768 | A * | 4/1998 | Bishop et al. | 200/50.01 |
| 5,978,209 | A * | 11/1999 | Montague et al. | 361/634 |
| 5,989,073 | A | 11/1999 | Kahoun | |
| 6,084,186 | A * | 7/2000 | Shaffer | 200/43.16 |
| 6,379,196 | B1 | 4/2002 | Greenberg | |
| 6,437,268 | B1 * | 8/2002 | Etscheidt et al. | 200/305 |
| 6,981,901 | B2 | 1/2006 | Takaya | |
| 7,144,280 | B2 | 12/2006 | Cabrera | |
| 7,286,340 | B2 * | 10/2007 | Karim et al. | 361/647 |
| 2008/0002339 | A1 | 1/2008 | Dixon et al. | |

FOREIGN PATENT DOCUMENTS

WO WO 2006/133657 12/2006

* cited by examiner

*Primary Examiner*—Neil Abrams
*Assistant Examiner*—Phuong Nguyen
(74) *Attorney, Agent, or Firm*—Jose de la Rosa

(57) ABSTRACT

Certain exemplary embodiments can provide a system, which can comprise a lug coupler that comprises a set of bus bars. Each of the set of bus bars can be adapted to be releasably attached to a corresponding terminal of a set of terminals of a circuit breaker. The system can comprise a set of studs adapted to engage a corresponding set of apertures defined by an end connector of one of a set of electrical leads adapted to be electrically coupled to the lug coupler.

19 Claims, 5 Drawing Sheets

2000

DEVICES, SYSTEMS, AND METHOD FOR COUPLING ELECTRICAL CONDUCTORS

CROSS-REFERENCE TO RELATED APPLICATIONS

This application claims priority to, and incorporates by reference herein in its entirety, U.S. Provisional Patent Application Ser. No. 60/911,600, filed 13 Apr. 2007.

BACKGROUND

U.S. Pat. No. 6,379,196 (Greenberg), which is incorporated by reference herein in its entirety, allegedly discloses, "[a] termination connector for a circuit breaker is disclosed. The termination connector preferably includes a plurality of single pole screw receiving members integrally attached by a molded housing for unitary attachment to a line or load end of a circuit breaker to assist in holding a nut or nut plate adjacent each screw hole in the circuit breaker's terminal straps. The molded housing preferably includes a line of perforations between each single pole screw receiving member so that the correct number of single pole screw receiving members can be retained and the others can be knocked off along the line of perforations. Provisions are disclosed for adaption of the connector to metric or English standard nut hardware. In addition, the termination connector and circuit breaker are provided with mating attachment devices for providing a simple yet secure connection." See Abstract.

U.S. Pat. No. 5,989,073 (Kahoun), which is incorporated by reference herein in its entirety, allegedly discloses, "[a] power block includes an insulative block which is mounted to a panel and a plurality of connection mounts which are coupled to the insulative block. The insulative block includes a plurality of molded dividers and the connection mounts are located therebetween. Each connection mount includes at least one stud extending upward from the block and a conductor having first and second portions. The first portion of each conductor is conductively coupled to the one or more studs and the second portion extends through the block in a direction opposite the one or more studs. The second portion includes a free end provided with a connector directly couplable to a destination point. A preferred aspect of the invention is that the conductor is a copper braid partially covered in a tin plated copper sleeve. According to a first embodiment, the connector at the free end of the conductor is a sleeve extending over the free end and having a hole for directly receiving a lead from a power filter. According to a second embodiment, the second portion of the conductor is formed of solid copper and the connector is a tapered free end of the second portion of the conductor which is 'pluggable' into resilient clips. According to a third embodiment, the second portion of the conductors are substantially elongate and flexible, and the connector at the free end is a sleeve having a coupling slot or hole." See Abstract.

SUMMARY

Certain exemplary embodiments can provide a system, which can comprise a lug coupler that comprises a set of bus bars. Each of the set of bus bars can be adapted to be releasably attached to a corresponding terminal of a set of terminals of a circuit breaker. The system can comprise a set of studs adapted to engage a corresponding set of apertures defined by an end connector of one of a set of electrical leads adapted to be electrically coupled to the lug coupler.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide a system, which can comprise a lug coupler that comprises a set of bus bars. Each of the set of bus bars can be adapted to be releasably attached to a corresponding terminal of a set of terminals of a circuit breaker. The system can comprise a set of studs adapted to engage a corresponding set of apertures defined by an end connector of one of a set of electrical leads adapted to be electrically coupled to the lug coupler.

Certain exemplary embodiments can provide a lug coupler, which can be adapted for use as a wiring option for contractors, electricians, or anyone who might install a circuit breaker in a panelboard. In certain exemplary embodiments, the lug coupler can be field installed during an installation process of a circuit breaker and can be adapted to be operatively coupled to compression and/or mechanical/pressure connectors and/or lugs in certain applications.

During installation of modular panelboards, certain exemplary embodiments can electrically couple specific connectors and/or lugs to a circuit breaker. In certain exemplary embodiments, the lug coupler can be provided as a kit for field installation. Certain exemplary embodiments can be field installed on certain panelboard devices and/or can be electrically coupled to a specific connector and/or a specific lug. The lug coupler can be compliant with one or more Underwriters Laboratory standards for use in a product, such as electrically coupling electrical leads to a circuit breaker.

In certain exemplary embodiments the lug coupler can be operatively mounted in line with corresponding circuit breaker terminals in a manner such that an overall width of our standard unit is not changed by installation of the lug coupler.

Figure 1:
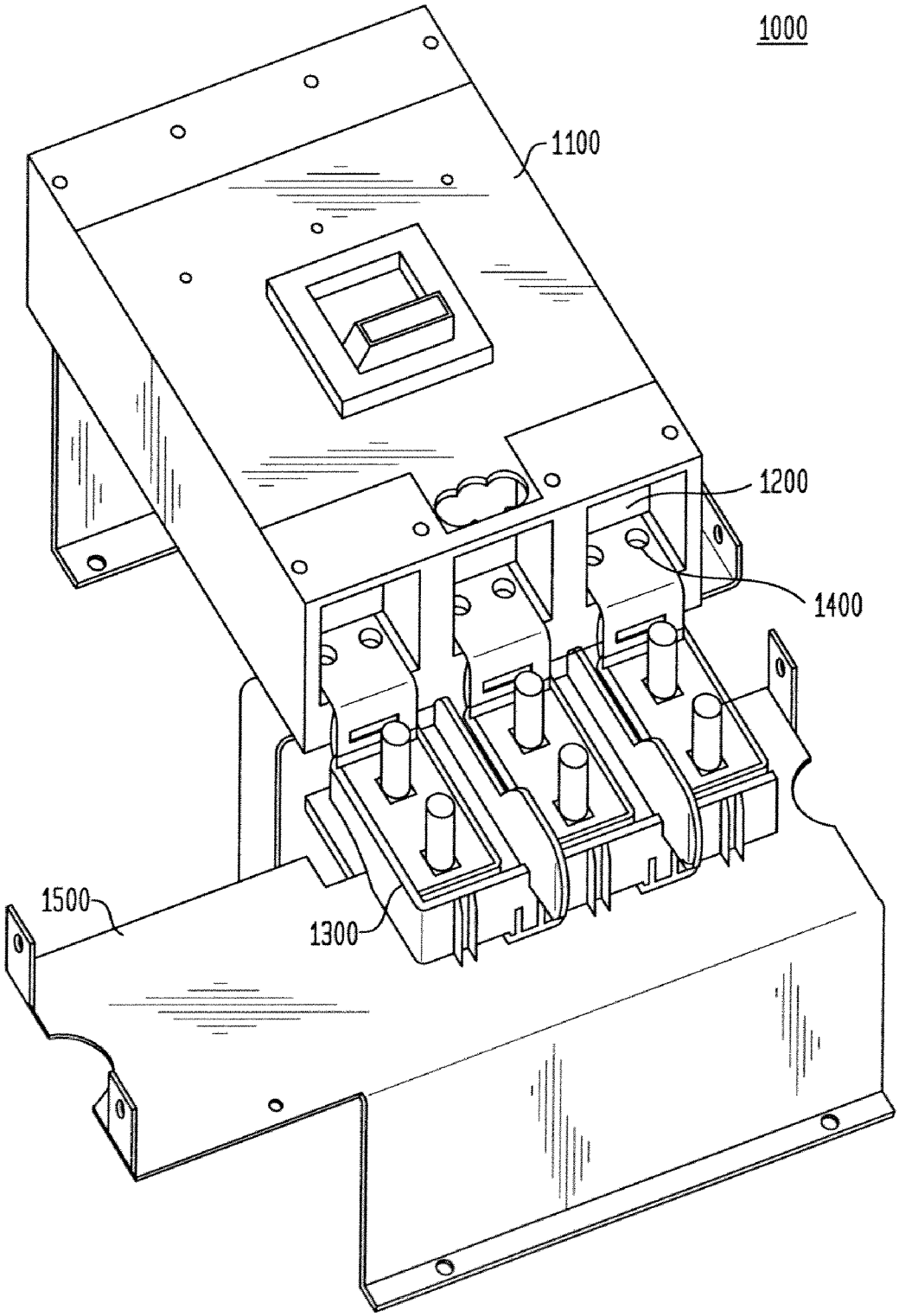
FIG. 1 is a perspective view of an exemplary embodiment of a system 1000.

FIG. 1 is a perspective view of an exemplary embodiment of a system 1000, which can comprise a circuit breaker 1100. Circuit breaker 1100 can comprise a set of terminals 1200. Circuit breaker 1100 can be electrically coupled to a set of electrical leads via a lug coupler 1300. Lug coupler 1300 can be mechanically and/or electrically coupled to circuit breaker 1100 via set of terminals 1200. Lug coupler 1300 can be mechanically coupled to a support 1500. Each of a set of bus bars 1400 can be adapted to be releasably attached to a corresponding terminal of set of terminals 1200 of circuit breaker 1100, such as via one or more fasteners. Lug coupler 1300 can be adapted to mount in line with set of terminals 1200 of circuit breaker 1100. By mounting in line with circuit breaker 1100, certain operative embodiments of lug coupler 1300 can couple the set of electrical leads to circuit breaker 1100 without increasing a width of system 1000.

Figure 2:
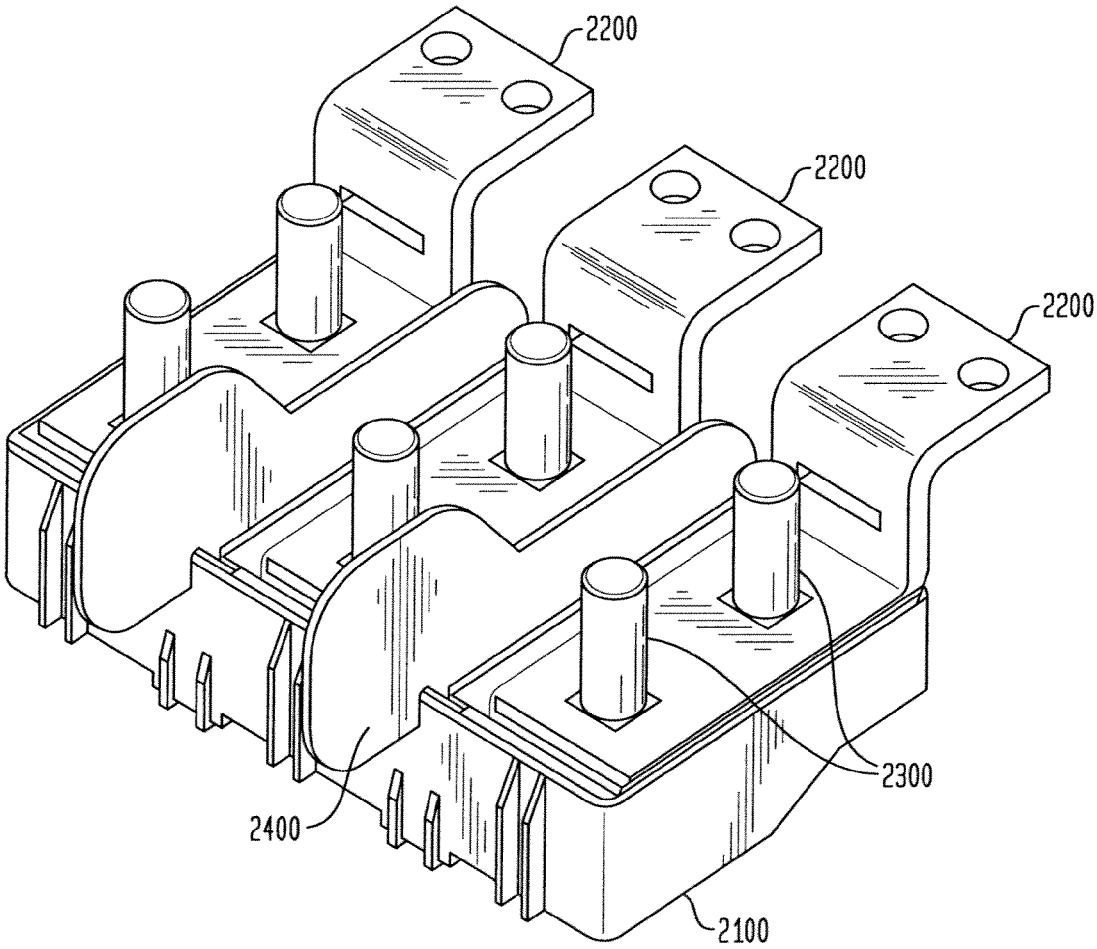
FIG. 2 is a perspective view of an exemplary embodiment of a lug coupler system 2000.

FIG. 2 is a perspective view of an exemplary embodiment of a lug coupler system 2000, which can comprise a set of bus bars 2200. Each of set of bus bars 2200 can be adapted to be releasably attached to a corresponding terminal of a set of terminals of a circuit breaker. Lug coupler system 2000 can comprise a set of studs 2300, which can be adapted to engage a corresponding set of apertures defined by an end connector of one of a set of electrical leads adapted to be electrically coupled to lug coupler system 2000.

Lug coupler system 2000 can comprise an electrically non-conductive housing 2100 adapted to electrical isolate any pair of electrical leads releasably attachable to lug coupler system 2000. Lug coupler system 2000 can comprise a set of electrically non-conductive isolation tabs 2400. Each of set of electrically non-conductive isolation tab 2400 can be adapted to electrically isolate a pair of terminals of electrical leads that are operatively coupled to lug coupler system 2000.

Figure 3:
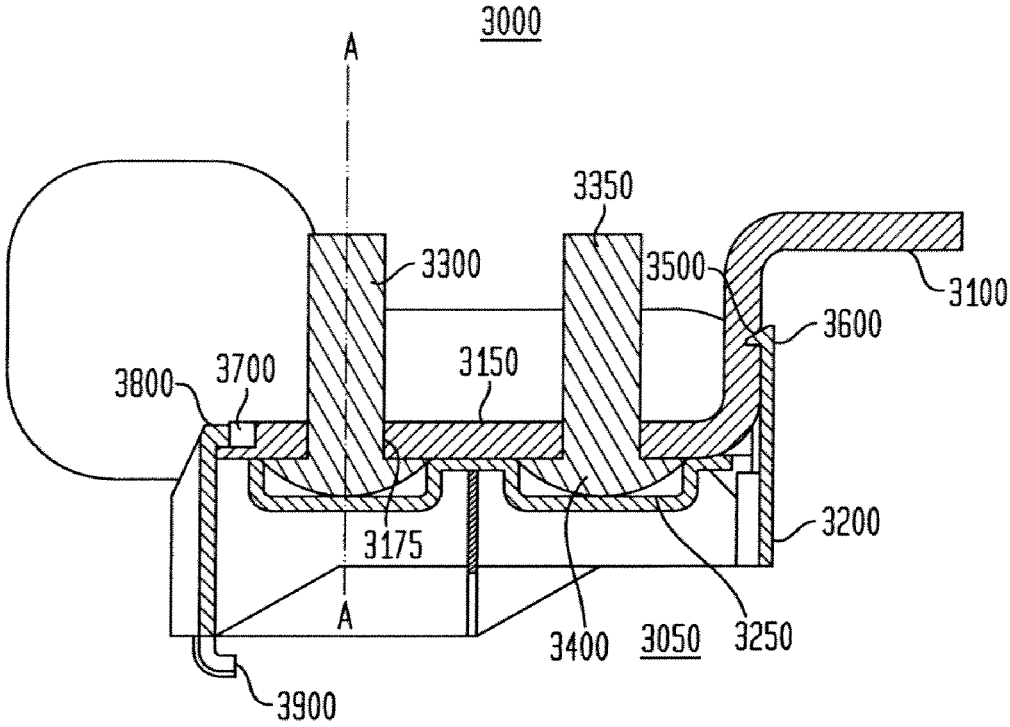
FIG. 3 is a sectional view of an exemplary embodiment of a system 3000.

FIG. 3 is a sectional view of an exemplary embodiment of a system 3000, which can comprise a bus bar 3100. Bus bar 3100 can be one of a set of bus bars, such as set of bus bars 2200 of FIG. 2. Bus bar 3100 can be adapted to be snapably coupled, via an engagement of a tooth 3600 with a corresponding aperture and/or indentation 3500, to an electrically non-conductive housing 3200 of a lug coupler 3050. Although system 3000 illustrates that tooth 3600 is a part of non-conductive housing 3200 and corresponding aperture and/or indentation 3500 is defined by bus bar 3100, certain exemplary embodiments can comprise tooth 3600 as a part of bus bar 3100 and corresponding aperture and/or indentation 3500 can be defined by non-conductive housing 3200. When engaged, tooth 3600 and aperture and/or indentation 3500 can be adapted to substantially nondestructively releasably couple bus bar 3100 to non-conductive housing 3200. Lug coupler 3050 can comprise a mounting tab 3900, which can be adapted to substantially nondestructively releasably couple lug coupler 3050 to a port defined by a support, such as support 1500 of FIG. 1.

Bus bar 3100 can comprise a lip 3700. Certain exemplary embodiments can define a cavity instead of lip 3700. When bus bar 3100 is snapably coupled to electrically non-conductive housing 3200, lip 3700 can be adapted to contact an extended edge 3800, and/or the cavity, of electrically non-conductive housing 3200. Extended edge 3800 can be adapted to restrain at least a portion of a coupled bus bar, such as bus bar 3100, from motion in a direction substantially parallel to a longitudinal axis A-A of a stud 3300 mounted through coupled bus bar 3100. When lip 3700 is operatively engaged with extended edge 3800 and tooth 3600 is operatively engaged with aperture and/or indentation 3500:

- bus bar 3100 can be restrained from motion in the direction substantially parallel to a longitudinal axis A-A of stud 3300; and
- bus bar 3100 can be restrained from motion in a direction substantially perpendicular to longitudinal axis A-A of stud 3300.

A head 3400 of each of a set of threaded studs 3350 can be substantially surrounded and electrically isolated by defined cavities 3250 of electrically non-conductive housing 3200. Each of a set of bus bars, such as a set of bus bars that comprises bus bar 3100, can comprise and/or define a pad, such as pad 3150. Each pad, such as pad 3150, can define a set of apertures 3175 adapted to receive set of studs 3350. Each of the set of pads can be electrically coupled to set of studs 3350 comprised by lug coupler 3050. Each of set of studs 3350 can be adapted to be mechanically coupled to an end connector of a set of electrical leads.

Figure 4:
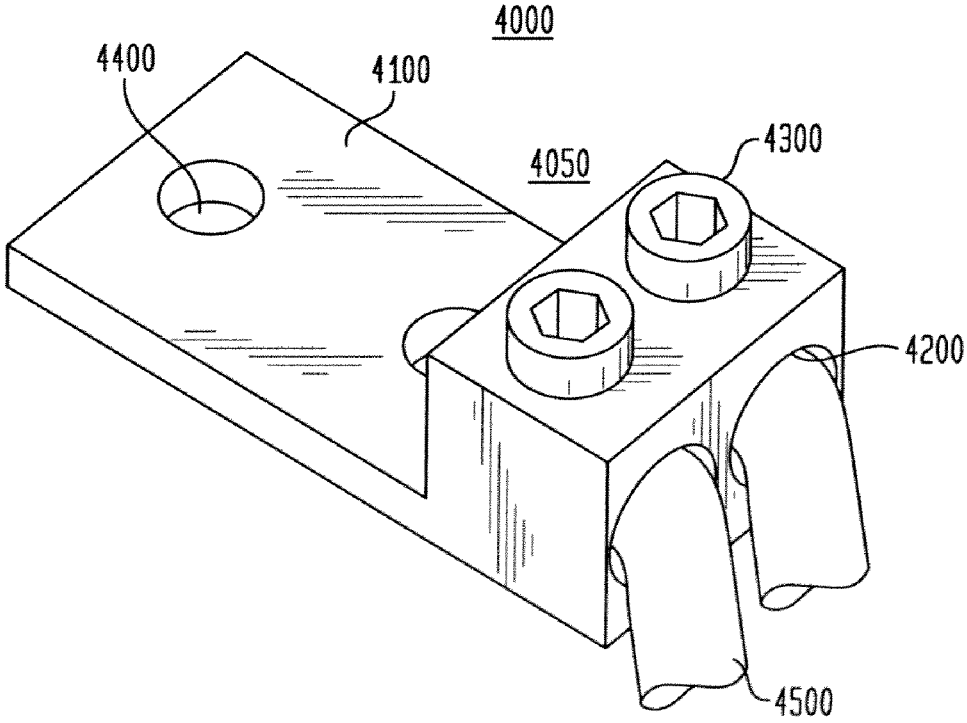
FIG. 4 is a perspective view of an exemplary embodiment of a mechanical type end connector system 4000.

FIG. 4 is a perspective view of an exemplary embodiment of a mechanical type end connector system 4000, which can be electrically and/or mechanically coupled to an electrical lead, such as an electrical lead couplable to system 1000 of FIG. 1. Mechanical type end connector system 4000 can:

- comprise a mechanical type end connector 4050;
- define a set of electrical conductor ports 4200, each of which can be adapted to receive an electrical lead of a set of electrical leads 4500;
- comprise a set of fasteners 4300, each of which can be adapted to secure an electrical lead to mechanical type end connector 4000; and/or
- define a set of circuit breaker terminal ports 4200, which can be adapted to allow mechanical type end connector 4000 to be electrically and/or mechanically coupled to a set of studs of a lug coupler such as lug coupler 3050 of FIG. 3.

Figure 5:
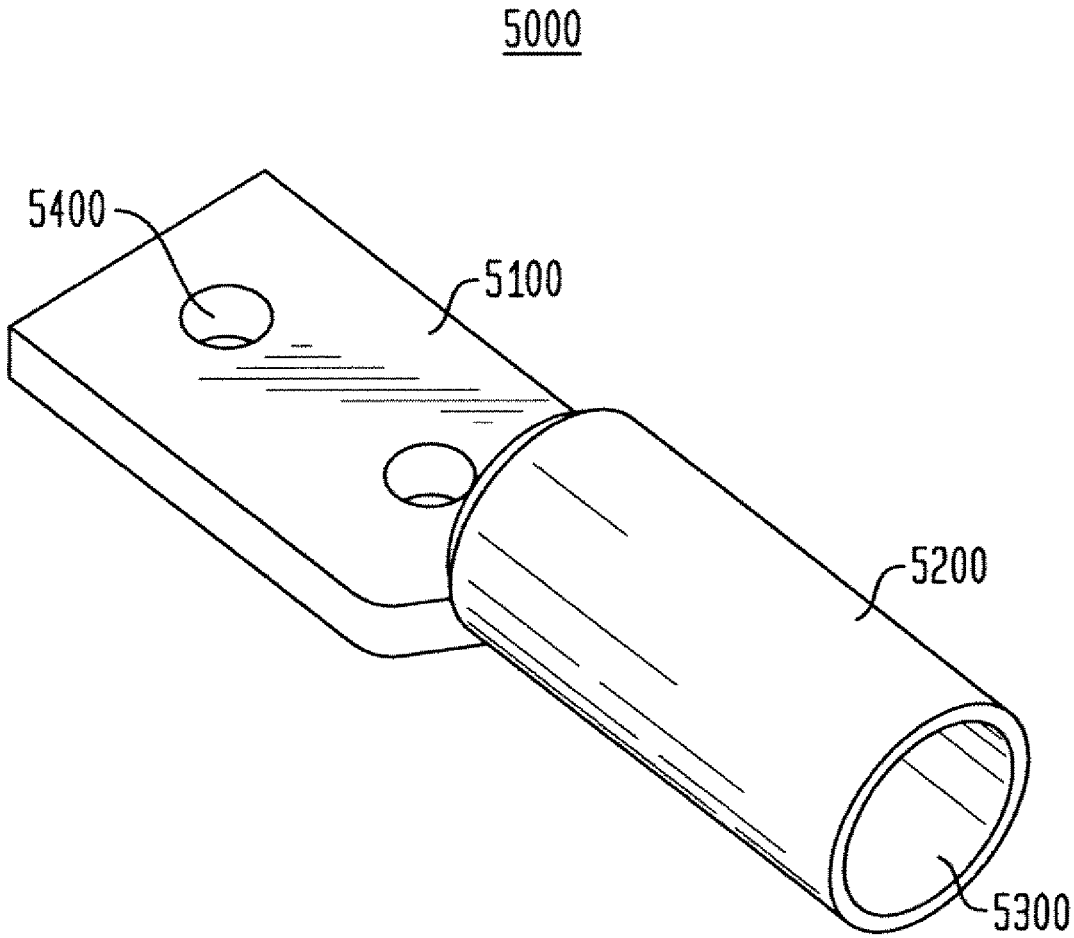
FIG. 5 is a perspective view of an exemplary embodiment of a compression type end connector 5000.

FIG. 5 is a perspective view of an exemplary embodiment of a compression type end connector 5000, which can be electrically and/or mechanically coupled to an electrical lead, such as an electrical lead couplable to system 1000 of FIG. 1. Compression type end connector 5000 can:

- comprise an end connector pad adapted to be electrically coupled to a pad, such as pad 3150 of FIG. 3.
- define an electrical conductor port 5300, which can be adapted to receive an electrical lead;
- comprise a crimpable portion 5200, which can be adapted, when crimped, to secure an electrical lead to compression type end connector 5000; and/or
- define a set of circuit breaker terminal ports 5400, which can be adapted to allow compression type end connector 5000 to be electrically and/or mechanically coupled to a set of studs of a lug coupler such as lug coupler 3050 of FIG. 3.

Figure 6:
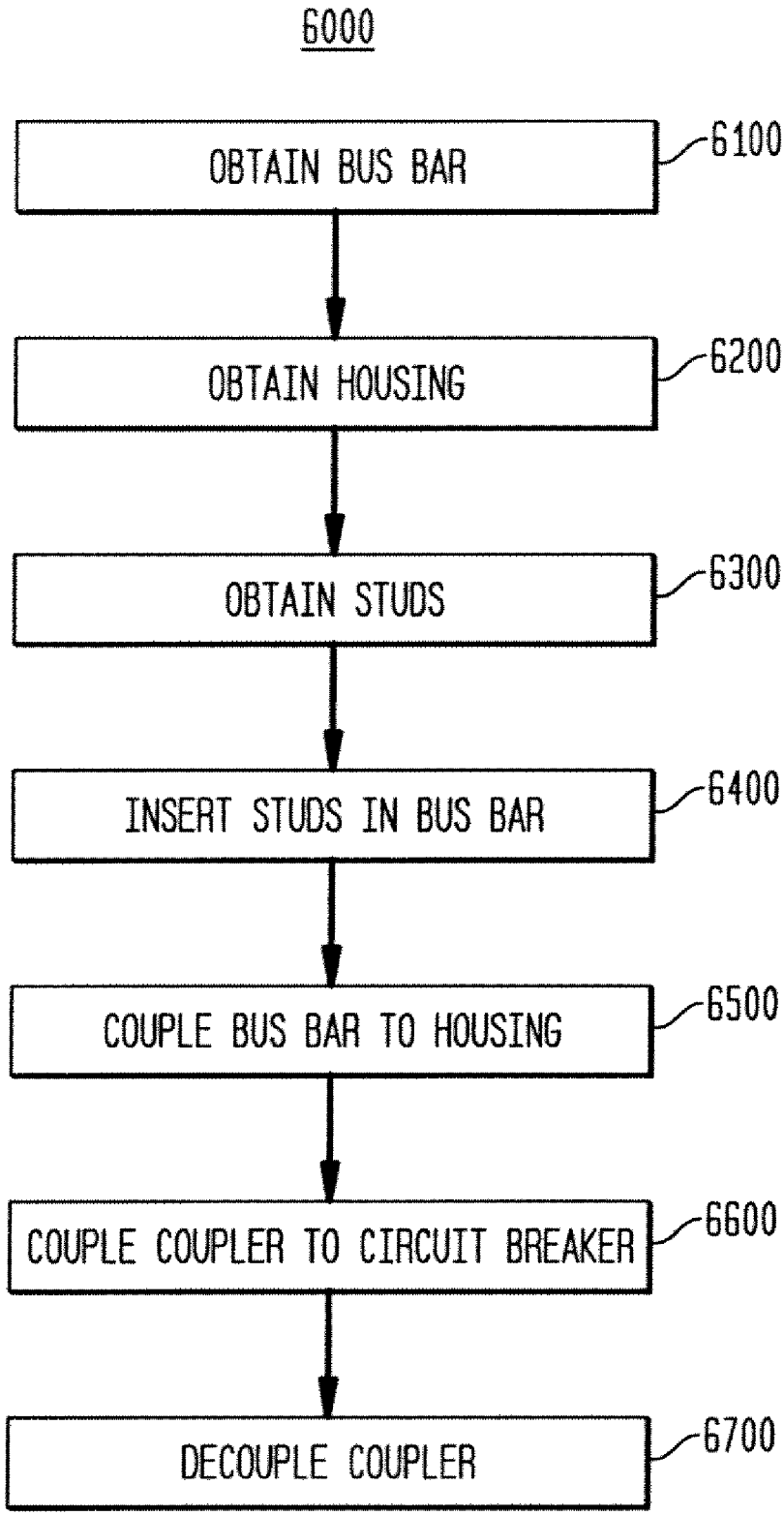
FIG. 6 is a flowchart of an exemplary embodiment of a method 6000.

FIG. 6 is a flowchart of an exemplary embodiment of a method 6000. At activity 6100, a bus bar can be obtained. The bus bar can be stamped, cast, manufactured, and/or fabricated from an electrically conductive material. The electrically conductive material can be any electrically conductive substance, such as copper, aluminum, steel, tin, and/or zinc, etc. At activity 6200, an electrically non-conductive housing can be obtained. The electrically non-conductive housing can be fabricated and/or manufactured from any substantially electrically non-conductive material. For example, the electrically non-conductive housing can comprise plastic, rubber, elastomer, silicon dioxide, Teflon™, polyethylene, crosslinked polyethylene, polyvinyl chloride, rubber-like polymers, oil impregnated paper, silicone, and/or modified ethylene tetrafluoroethylene, etc.

At activity 6300, studs can be obtained. The studs can be threaded fasteners adapted to electrically couple a National Electric Manufacturers Association (NEMA) type II end connector coupled to an electrical lead to a lug coupler. At activity 6400, the studs can be inserted in the bus bar. In certain exemplary embodiments, the studs can be threaded and nuts can be attached to retain the studs during assembly of the lug coupler.

At activity 6500, the bus bar can be operatively coupled to the electrically non-conductive housing. For example, each bus bar can be snapably coupled to the electrically non-conductive housing of the lug coupler. In certain exemplary embodiments, each of the set of bus bars can be snapably coupled, via an engagement of a tooth with a corresponding aperture and/or edge, to the electrically non-conductive housing of the lug coupler.

At activity 6600, the coupler can be electrically and/or mechanically coupled, such as via a releasable attachment, to a circuit breaker. The lug coupler can comprise the set of bus bars. Each of the set of bus bars can be adapted to be releasably attached to a corresponding terminal of a set of terminals of the circuit breaker. The lug coupler can comprise a mounting tab. The mounting tab can be adapted to releasably attach the lug coupler to a port defined by a support. The mounting tab can define an aperture adapted to receive a fastener that can releasably attach the lug coupler to the support. Each of the set of bus bars can comprise a lip and/or flat surface. When a bus bar is snapably coupled to the electrically non-conductive housing, the lip and/or flat surface can be adapted to contact an extended edge of the electrically non-conductive housing. The lug coupler can comprise a set of threaded studs adapted to engage a corresponding set of apertures defined by an end connector of one of a set of electrical leads. A head of each of the set of threaded studs can be substantially surrounded and electrically isolated by defined cavities of the electrically non-conductive housing. Each of the set of electrical leads can be electrically and/or mechanically coupled to the lug coupler. At activity 6700, the coupler can be electrically and/or mechanically decoupled from the circuit breaker. For example, one or more threaded fasteners operatively coupling the coupler to the circuit breaker can be removed.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

about—around.

activity—an action, act, deed, function, step, and/or process and/or a portion thereof.

adapted to—suitable, fit, and/or capable of performing a specified function.

adapter—a device used to effect operative compatibility between different parts of one or more pieces of an apparatus or system.

adjacent—in close proximity to, near, next to, and/or adjoining.

after—subsequent in time.

and/or—either in conjunction with or in alternative to.

aperture—an opening, hole, gap, passage, and/or slit.

apparatus—an appliance and/or device for a particular purpose.

applied—incident directly and/or indirectly upon.

approximately—about and/or nearly the same as.

assembly—the act of gathering related records into a group.

at least—not less than.

attach—to fasten, secure, couple, and/or join.

attachable—capable of being fastened, secured, coupled, and/or joined.

axis—a straight line about which a body or geometric object rotates or can be conceived to rotate and/or a center line to which parts of a structure or body can be referred.

being in effect; operating.

between—in a separating interval and/or intermediate to.

bus bar—a common electrical power terminal to which multiple circuits are electrically coupled through either fuses or circuit breakers.

can—is capable of, in at least some embodiments.

cavity—a hollow area within an object.

circuit—an electrically conductive pathway and/or a communications connection established across two or more switching devices comprised by a network and between corresponding end systems connected to, but not comprised by the network.

circuit breaker—a re-settable device adapted to automatically open an alternating current electrical circuit to protect the circuit from damage caused by overload and/or short circuit.

component—a constituent element and/or part.

compression type end connector—an end connector adapted to be mechanically and electrically coupled to an electrical lead via crimping a portion of the end connector to the electrical lead.

comprises—includes, but is not limited to, what follows.

comprising—including but not limited to.

conduct—to act as a medium for conveying something such as heat and/or electricity.

connect—physically or logically join, link, couple, and/or fasten two or more entities.

contact—to touch.

corresponding—related, associated, accompanying, similar in purpose and/or position, conforming in every respect, and/or equivalent and/or agreeing in amount, quantity, magnitude, quality, and/or degree.

couple(d)—to join, connect, and/or link two things together.

coupleable—capable of being joined, connected, and/or linked together.

coupling—(n) a device adapted to join, connect, and/or link. (v) joining, connecting, and/or linking.

cross-section—a section formed by a plane cutting through an object at a right angle to an axis.

decouple—to disjoin, disconnect, and/or unlink two things define—to establish the meaning, relationship, outline, form, and/or structure of; and/or to precisely and/or distinctly describe and/or specify.

device—a machine, manufacture, and/or collection thereof.

diameter—a length of a straight line segment passing through a center of an object and terminating at the periphery thereof.

direction—a spatial relation between something and a course along which it points and/or moves; a distance independent relationship between two points in space that specifies the position of either with respect to the other; and/or a relationship by which the alignment and/or orientation of any position with respect to any other position is established.

each—every one of a group considered individually.

electrical—relating to producing, distributing, and/or operating by electricity.

electrical device—a machine or component utilizing electrical power.

electrical lead—an electrically conductive wire and/or cable.

electrical meter—an assembled system configured to measure a usage of electrical energy.
electrically coupled—connected in a manner adapted to allow a flow of electricity therebetween.
electrically non-conductive—substantially resistant to a flow of electrons caused by a gradient of electrical potential.
end connector—an electrically conductive device adapted to facilitate mechanical and electrically coupling of an end of an electrical lead to another electrical device.
engage—to mesh, mate, connect, and/or interlock and/or to contact, cause to contact, interact, and/or cause to interact.
extend—to reach spatially outward.
extended edge—a lip protruding from a surface.
fastener—a device, component, and/or system adapted for attachment, such as a hook and/or loop of a hook and loop fastener system, button, hook, catch, snap, latch, buckle, loop, tie, clamp, connector, nail, screw, bolt, staple, rivet, coupler, link, band, zipper, releasable adhesive, and/or any other releasable attachment mechanism, and/or a seam, stitch, glue, bond, weld, and/or any other permanent attachment mechanism.
from—used to indicate a source.
further—in addition.
head—a terminal portion of a threaded fastener that is larger in diameter than a threaded portion of the fastener.
housing—something that covers, encloses, protects, holds, and/or supports, such as a frame, box, and/or chassis.
in line—coupled such that a longitudinal axis of a mounting surface of a first coupled device is substantially aligned with a longitudinal axis of a mounting surface of a second coupled device.
increase—to make and/or become greater and/or larger.
install—to connect or set in position and prepare for use.
into—to a condition, state, or form of.
isolate—to substantially resist an electrical coupling.
lip—a protruding edge.
longitudinal axis—a straight line defined parallel to an object's length and passing through a centroid of the object.
lug coupler—a system adapted to electrically couple an end connector of an electrical conductor to a circuit breaker terminal, the system adapted for installation in a location other than a facility that manufactures the circuit breaker.
may—is allowed and/or permitted to, in at least some embodiments.
mechanical type end connector—an end connector adapted to be mechanically and electrically coupled to an electrical lead via a fastener that passes through an aperture of the end connector and contacts the electrical lead.
mechanically—in a mechanical manner; by a mechanism.
mechanically couple—to join together in a mechanical manner; by a mechanism.
method—a process, procedure, and/or collection of related activities for accomplishing something.
motion—changing position or place.
mount—(n) that upon which a thing is attached; (v) to couple, fix, and/or attach on and/or to something.
mounting tab—a protruding edge of a first surface adapted to engage a corresponding edge of a second surface.
not—a negation of something.
opening—an aperture.
pad—a surface adapted to serve as a base for attachment of an end connector.
pair—a quantity of two of something.
parallel—of, relating to, or designating lines, curves, planes, and/or or surfaces everywhere equidistant and/or an arrangement of components in an electrical circuit that splits an electrical current into two or more paths.
perpendicular—intersecting at or forming substantially right angles.
place—(v.) to put in a particular position.
plurality—the state of being plural and/or more than one.
port—a defined aperture.
portion—a part, component, section, percentage, ratio, and/or quantity that is less than a larger whole. Can be visually, physically, and/or virtually distinguishable and/or non-distinguishable.
predetermined—established in advance.
protrude—to extend out or project beyond a predetermined threshold and/or surface.
provide—to furnish, supply, give, convey, send, and/or make available.
receive—to gather, take, acquire, obtain, accept, get, and/or have bestowed upon.
relative—considered with reference to and/or in comparison to something else.
releasably—capable of being freed, in a substantially non-destructive manner, from something that binds, fastens, or holds back.
releasably attach—to fasten together in a manner that allows for substantially non-destructive unfastening.
responsive—reacting to an influence and/or impetus.
restrain—to limit and/or restrict.
said—when used in a system or device claim, an article indicating a subsequent claim term that has been previously introduced.
set—a related plurality of predetermined elements; and/or one or more distinct items and/or entities having a specific common property or properties.
snapably—to be able to open, close, and/or fit together with a click.
stud—a small protrusion projecting from a surface.
substantially—to a considerable, large, and/or great, but not necessarily whole and/or entire, extent and/or degree.
such that—
support—to bear the weight of, especially from below.
surround—to encircle, enclose, and/or confine on several and/or all sides.
system—a collection of mechanisms, devices, machines, articles of manufacture, processes, data, and/or instructions, the collection designed to perform one or more specific functions.
terminal—the point of primary current entry to, or point of primary current departure from, a circuit breaker.
threaded—comprising a helical or spiral ridge on a screw, nut, or bolt.
through—in one side and out another side of.
tooth—a projection from a first surface that is adapted to engage a corresponding aperture of a second surface.
translational—along a linear and/or curvilinear path; non-rotational.
via—by way of and/or utilizing.
when—at a time.
wherein—in regard to which; and; and/or in addition to.
width—a measurement of the extent of something along a dimension.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive.

What is claimed is:

1. A system, comprising:

a lug coupler comprising a set of bus bars, each of said set of bus bars releasably attached to a corresponding terminal of a set of terminals of a circuit breaker, each of said set of bus bars snapably connected, via an engagement of a tooth with a corresponding aperture, to an electrically non-conductive housing of said lug coupler, said lug coupler comprising a mounting tab, said mounting tab releasably attaching said lug coupler to a port defined by a support, each of said set of bus bars comprising a lip, when each of said set of bus bars is snapably connected to said electrically non-conductive housing, said lip contacting an extended edge of said electrically non-conductive housing, said extended edge restraining a connected bus bar from motion in a direction substantially parallel to a longitudinal axis of a stud mounted through said connected bus bar.

2. The system of claim 1, further comprising:

a set of studs engaging a corresponding set of apertures defined by an end connector of one of a set of electrical leads electrically connected to said lug coupler.

3. The system of claim 1, further comprising:

a set of threaded studs engaging a corresponding set of apertures defined by an end connector of one of said set of electrical leads, a head of each of said set of threaded studs substantially surrounded and electrically isolated by said defined cavities of said electrically non-conductive housing.

4. The system of claim 1, further comprising:

said circuit breaker.

5. The system of claim 1, further comprising:

said set of electrical leads.

6. The system of claim 1, wherein:

said electrically non-conductive housing electrically isolating any pair of electrical leads releasably attachable to said lug coupler.

7. The system of claim 1, wherein:

each of said set of bus bars defines a pad; and each pad defines a set of apertures receiving a set of studs.

8. The system of claim 1, wherein:

said lug coupler is electrically connecting said set of electrical leads to said circuit breaker.

9. The system of claim 1, wherein:

each of said set of bus bars comprises a pad; and each of said set of pads electrically connected to a set of studs comprised by said lug coupler.

10. The system of claim 1, wherein:

an electrical lead of said set of electrical leads comprises a compression type end connector.

11. The system of claim 1, wherein:

an electrical lead of said set of electrical leads comprises a mechanical type end connector.

12. The system of claim 1, wherein:

said housing substantially surrounds each head of a set of studs, each of said set of studs mechanically connected to an end connector of said set of electrical leads.

13. The system of claim 1, wherein:

said lug coupler mounted in line with terminals of said circuit breaker.

14. A method comprising a plurality of activities, comprising:

electrically coupling a lug coupler to a circuit breaker, said lug coupler comprising a set of bus bars, each of said set of bus bars releasably attached to a corresponding terminal of a set of terminals of a circuit breaker, each of said set of bus bars snapably connected, via an engagement of a tooth with a corresponding aperture, to an electrically non-conductive housing of said lug coupler, said lug coupler comprising a mounting tab, said mounting tab releasably attaching said lug coupler to a port defined by a support, each of said set of bus bars comprising a lip, said lug coupler comprising a set of threaded studs engaging a corresponding set of apertures defined by an end connector of one of said set of electrical leads, a head of each of said set of threaded studs substantially surrounded and electrically isolated by said defined cavities of said electrically non-conductive housing.

15. The method of claim 14, further comprising:

electrically disconnecting said lug coupler from said circuit breaker.

16. The method of claim 14, further comprising:

electrically connecting an electrical lead of said set of electrical leads to said lug coupler.

17. The method of claim 14, further comprising:

snapably connecting each of said set of bus bars to said electrically non-conductive housing of said lug coupler.

18. The method of claim 14, wherein:

said lug coupler is releasably attached to said circuit breaker.

19. A device, comprising:

a set of bus bars, each of said set of bus bars releasably attached to a corresponding terminal of a set of terminals of a circuit breaker, each of said set of bus bars snapably connected, via an engagement of a tooth with a corresponding aperture, to an electrically non-conductive housing of, said electrically non-conductive housing comprising a mounting tab, said mounting tab releasably attaching said device to a port defined by a support, each of said set of bus bars comprising a lip, said housing substantially surrounding each head of a set of studs, each of said set of studs mechanically connected to an end connector of said set of electrical leads.

* * * * *